United States Patent [19]

Gibson

[11] Patent Number: 4,816,296

[45] Date of Patent: Mar. 28, 1989

[54] TANGENTIAL JET AIR PIPE COATING APPARATUS AND METHOD

[76] Inventor: Jack E. Gibson, 4905 Pepperidge Dr., Odessa, Tex. 79761

[21] Appl. No.: 913,634

[22] Filed: Sep. 30, 1986

Related U.S. Application Data

[63] Continuation of Ser. No. 723,422, Apr. 15, 1988, abandoned, which is a continuation-in-part of Ser. No. 516,661, Jul. 21, 1983, abandoned, which is a continuation of Ser. No. 180,191, Aug. 22, 1980, abandoned, which is a continuation of Ser. No. 862,261, Dec. 20, 1977, Pat. No. 4,243,699.

[51] Int. Cl.[4] ..... B05D 1/12

[52] U.S. Cl. ..... 427/183; 427/181; 427/195; 427/233; 427/239; 118/317; 118/318; 118/308; 118/DIG. 10

[58] Field of Search ..... 427/181, 183, 195, 233, 427/239; 118/317, 318, 308, DIG. 10

[56] References Cited

U.S. PATENT DOCUMENTS

| | | | |
|---|---|---|---|
| 3,304,012 | 2/1967 | Sem | 239/405 |
| 3,554,164 | 1/1971 | West | 118/308 X |
| 3,901,184 | 8/1975 | Payne et al. | 118/308 X |
| 3,974,306 | 8/1976 | Inamura et al. | 427/181 X |
| 4,090,666 | 5/1978 | Peck | 239/692 |
| 4,243,699 | 1/1981 | Gibson | 427/181 |
| 4,382,421 | 5/1983 | Warren et al. | 118/663 |
| 4,454,173 | 6/1984 | Koga | 427/181 X |

FOREIGN PATENT DOCUMENTS

| | | | |
|---|---|---|---|
| 686283 | 5/1964 | Canada | 118/308 |

*Primary Examiner*—Shrive Beck

*Attorney, Agent, or Firm*—Marcus L. Bates

[57] ABSTRACT

The difficulty of applying uniform plastic coatings to the interior of pipe and other tubular goods increases in proportion to the diameter and length of the pipe. Epoxy is one of the most satisfactory plastic coatings for use on oilfield pipe. An epoxy coating preferably is applied on powdered form to the heated, rotating pipe interior, where the plastic is fused into a continuous film and thereafter the pipe is cooled as the film solidifies to provide a superior coating which protects the metal pipe surface from chemically reacting with the material flowing therethrough, thereby elongating the life of the pipe.

13 Claims, 4 Drawing Sheets

TANGENTIAL JET AIR PIPE COATING APPARATUS AND METHOD

This patent application is a continuation of patent application Ser. No. 723,422 filed Apr. 15, 1985, now abandoned. This patent application is a continuation-in-part of patent application Ser. No. 516,661 filed July 21, 1983 which was abandoned and refiled as patent application Ser. No. 786,818 filed Oct. 11, 1985. Patent Application Ser. No. 516,661 filed July 21, 1983 was a continuation of patent application Ser. No. 180,191 filed Aug. 22, 1980, now abandoned, which was a continuation of patent application Ser. No. 862,261 filed Dec. 20, 1977 now U.S. Pat. No. 4,243,699 issued Jan. 6, 1981. Patent application Ser. No. 862,261 was copending with patent application Ser. No. 704,965 filed July 13, 1976 now U.S. Pat. No. 4,089,998 issued May 16, 1978, which was copending with patent application Ser. No. 795,127 filed May 9, 1977 now U.S. Pat. No. 4,122,798 issued Oct. 31, 1978.

BACKGROUND OF THE INVENTION

As pointed out therein, the inside peripheral wall surface of a heated pipe can be coated in a superior manner by passing a pocket comprised of a dense, fluidized bed of plastic through the interior of a heated, rotating pipe so that the hot interior surface of the pipe is contacted by the plastic particles, whereupon the particles fuse to the inside wall of the pipe, thereby enabling a uniform, continuous plastic coating to be achieved which is superior to other coatings known at that time. Following this discovery, Applicant has found other useful and novel processes by which the pocket of dispersed plastic particles can be transferred into and forced through the pipe in a particular flow pattern in order to achieve still a greater and unexpected coating advantage. This new discovery is especially beneficial in coating large diameter pipe of considerable length, and this new process is the subject of the instant patent application.

SUMMARY OF THE INVENTION

The present invention comprehends both method and apparatus by which the inner surface area of a pipe or pipe-like member is coated with a uniform continuous coating of plastic. The plastic to be applied as a coating is in powder form. The pipe to be coated is heated above the softening or fusion temperature of the plastic particles and rotated about its longitudinal axis. One end of the pipe is removably connected in axial aligned relationship to a housing made in accordance with the present invention. A source of compressed air is connected to the other end of the housing and oriented to produce a flow along the longitudinal axis of the housing. A container, within which a charge of powdered plastic has been isolated, is connected adjacent to the axial air inlet. A valve means controls the flow of the powder charge from the container into the housing, and an air valve means controls the flow of compressed air into the inlet end of the housing. A plurality of tangential nozzles are arranged about the circumference of the housing and impart a spiraled flow into the fluidized or powder-air mixture as the mixture flows through the housing and through the pipe.

The powder container has previously been pressurized at a value in excess of the pressure within the housing, so that when the powder valve is opened, a rapid transfer of the powder charge occurs from the container into the housing. Immediately thereafter, the air valve is further opened, thereby increasing the axial air flow through the housing. The charge of powder is thereby mixed with air and formed into a pocket which is rotated with a spiral-like action as the pocket is formed within and travels from the housing and then through the pipe.

As the pocket of powdered plastic is forced through the heated rotating pipe, most of the particles of plastic contained within the pocket are brought into contact with the hot pipe wall and thereby fuse into a uniform continuous film of plastic. The small excess of the powdered plastic exits from the pipe outlet, where the excess powder can be reclaimed by using various prior art expedients, such as cyclone separators, cloth filters, and the like.

Accordingly, the present invention sets forth a method for coating the inside of metallic and metallic-like tubular goods with a continuous coating of plastic by isolating a charge of plastic powder upstream of the pipe to be coated, transferring the charge of powder into the pipe as a dense pocket of air admixed with the powder, and causing the pocket to assume a spiral flow path prior to the pocket entering the pipe. The spiraling pocket travels through the pipe while particles of plastic adhere to the interior sidewall of the pipe, with there being a small amount of plastic discharged from the outlet end of the pipe.

The mass flow of the air and powder through the heated rotating pipe is augmented by the placement of the tangential air inlets upstream of the inlet end of the pipe and downstream of the charge inlet from the container. This augmented air supply establishes a swirling mass flow of material through the pipe so that the powder pocket is rotated about the longitudinal central axis of the pipe as the air/powder mixture is forced through the pipe. This action of the powder pocket causes the plastic particles to be forced towards the interior sidewalls of the pipe.

In one embodiment of the present invention, the inlet end of the housing is left open to atmospheric pressure while suction is applied to the outlet end of the pipe. This suction, together with the tangential nozzles, provides the means by which the pocket of fluidized plastic particles is formed and transferred through the hot rotating pipe.

A primary object of this invention is the provision of a method of coating the interior of a pipe with a continuous uniform film or coating of plastic by placing a quantity of the powdered plastic upstream of the heated pipe and flowing the powder through the pipe as a spiraling pocket of air and powder so that most of the powdered plastic contained within the pocket contacts the heated pipe wall where it fuses into a uniform coating.

Another object of this invention is to plastic coat the interior of tubular elements by isolating a quantity of plastic particles upstream of a heated pipe and forcing the charge to assume a spiraled flow path as it flows through the pipe by applying a pressure differential across the charge, and thereby causing the charge to admix with air to form a pocket as it flows through the pipe.

Still another object of this invention is the provision of a process for internally coating pipe with a continuous film of plastic by forming a dormant charge of plastic particles upstream of a heated pipe and thereafter forcing the charge to flow through the pipe to force most of the particles contained within the charge to contact the hot interior pipe wall while the charge is in the act of flowing through the pipe, thereby fusing the particles into a continuous film which is substantially uniform along the entire length of the pipe.

Another and still further object of this invention is the provision of a method of powder coating the inside wall of a pipe by forming a fluidized pocket of plastic particles upstream of a heated pipe and flowing the pocket through the pipe under positive pressure and rotating the pipe as the particles contact and fuse to the pipe wall, so that a continuous plastic film extends for susbstantially the entire length of the pipe.

Still another object of the present invention is the provision of a method of coating the inside peripheral wall surface of a pipe by forming a charge of plastic upstream of the pipe inlet, applying a suction at the outlet end of the pipe, providing a tangential air flow between the pipe inlet and the charge, thereby forcing the pocket of plastic to be entrained into a spiraling pocket which is a dense fluidized bed of finite length. As the formed pocket of plastic particles spirals through the pipe, the individual particles thereof migrate towards and progressively contact the pipe wall and fuse into a continuous uniform layer which coats substantially the entire length of the pipe. Most of the plastic which forms the pocket is fused into a coating as the pocket is forced through the entire length of the pipe.

These and various other objects and advantages of the invention will become readily apparent to those skilled in the art upon reading the following detailed description and claims and by referring to the accompanying drawings.

The above objects are attained in accoradance with the present invention by the provision of a method for use with apparatus fabricated in a manner substantially as described in the above abstract and summary.

DETAILED DESCRIPTION OF THE PREFERRED EMBODIMENTS

Figure 1:
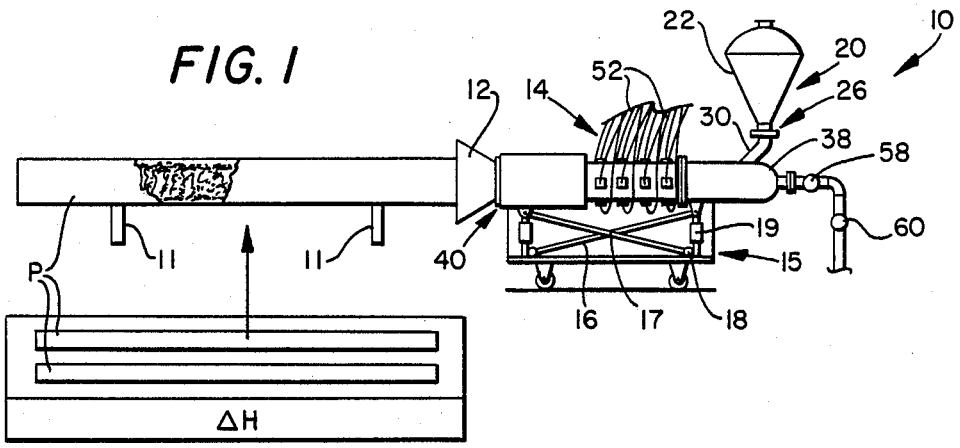
FIG. 1 is a perspective view which diagrammatically shows apparatus made in accordance with the present invention.

In the figures of the drawings, there is seen an apparatus 10 made in accordance with the present invention for powder coating the interior wall surface of a pipe P with a continuous film or coating of plastic. The apparatus 10 is removably attached to the inlet end of a pipe P by means of a rotatable cone 12 The rotatable cone is journaled to the outlet end of a cylindrical housing 14. The housing 14 is supported horizontally by an adjustable support frame 15 which enables the entire housing assembly 14 to be moved vertically into proper axial allignment respective to the longitudinal axial centerline of various diameter pipe P.

Cross members 16 are pinned at the medial length 17 and the upper end thereof. the other end of the cross member is supported by roller 18, so that cylinders 19 can be extended and retracted in order to elevate and lower the main housing 14, as the roller located at the distal end of a member 16 moves between the two positions indicated by the numerals 18 and 18'.

A powder container 20, which can take on several different forms, has a lower conical member 22 which forms an interior within which the illustrated powdered plastic resin material is isolated. Closure member 24 provides a sealed container while pressure regulator means 25 provides a predetermined elevated pressure upstream of the powder charge.

Valve means 26 preferably is provided with a sliding closure member 27 which is actuated by pneumatic cylinder 28. Valve means 26 is a quick opening valve which is sequentially operated respective to other apparatus of the present invention, which will be more clearly pointed out in greater detail hereinafter.

The container 20 has a curved outlet 30 connected to the interior of housing 14. Numeral 32 indicates the inlet port from powder container 20, and preferably is directed in a downstream direction respective to flow through the housing 14. Numeral 34 schematically indicates powder which has been translocated from container 20 into the interior of housing 14. The powder 34 is symbolic and in actual practice assumes the form of a dense cloud in the preferred form of the invention.

Numeral 38 indicates the inlet or upstream end of housing 14 while numeral 40 indicates the outlet end or downstream end of housing 14. D1 indicates the diameter of the cylindrical interior of the housing. The housing 14, cone 12, and pipe P may be aligned along a common longitudinal axial centerline.

Figure 2:
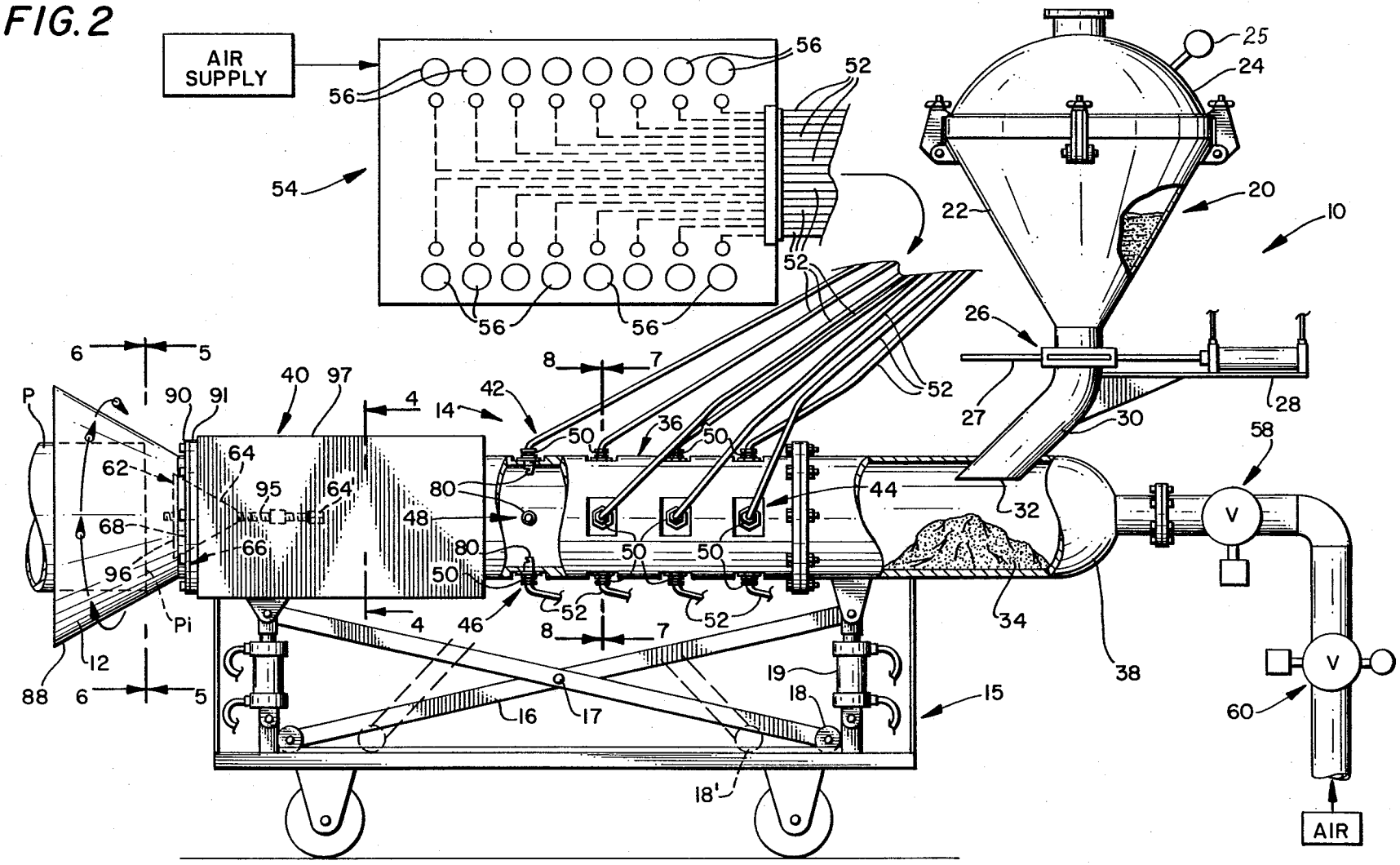
FIG. 2 is an enlarged, side elevational view of the apparatus disclosed in FIG. 1, with some parts thereof being broken away therefrom, and, some of the remaining parts being shown in cross-section.
Figure 5:
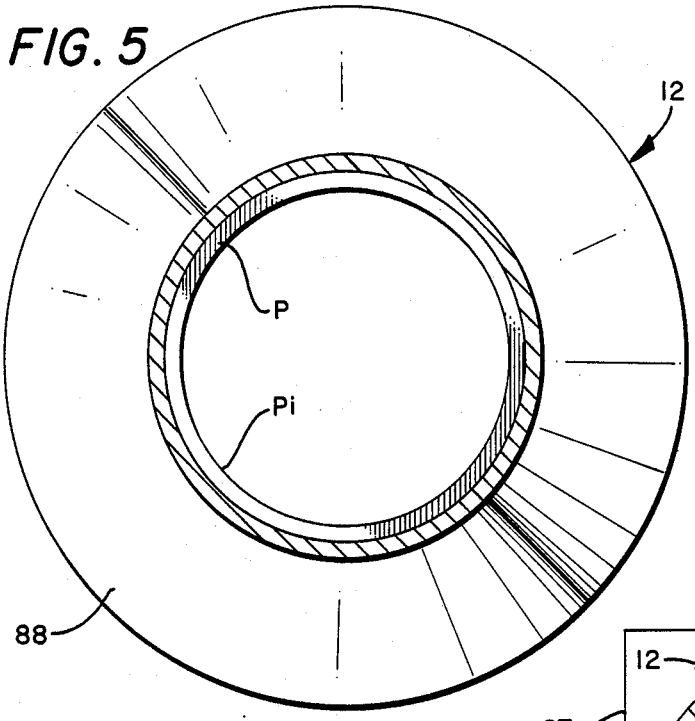
Figure 6:
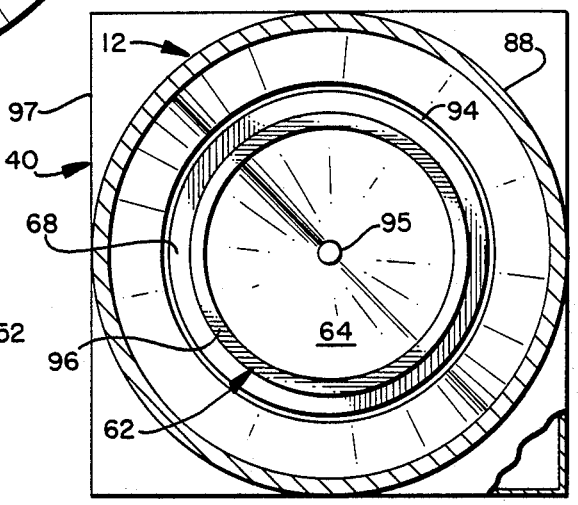
Figure 7:
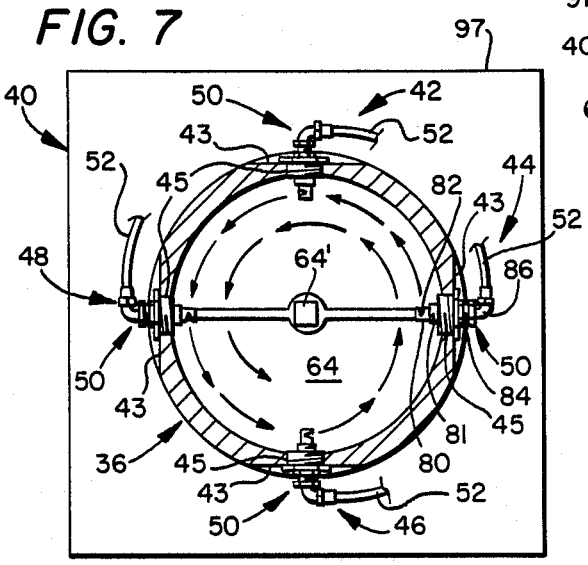
Figure 8:
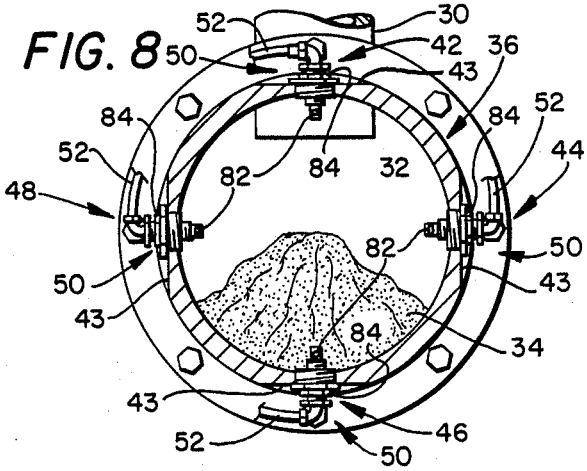

Numerals 42, 44, 46, 48 indicate groups of aligned tangential nozzles 50 with there being four groups of three nozzles 50 illustrated in FIG. 2. Numeral 52 schematically illustrates flow lines connected to air supply pannel 54. Air supply panel 54 includes a pressure regulator and pressure guage 56 connected to each of the nozzles so that each nozzle can be individually adjusted to achieve the desired flow characteristics of the air and powder mixture.

Air valve 58 is a quick opening ball type valve connected downsteam of regulator 60 so that air from regulataor 60 is directed along the longitudinal axis of the housing 14.

A cone assembly 62 has a conical surface 64 directed upstream with the central axis or apex 64' of the cone coinciding with the longitudinal axis of the housing. The cone is moved longitudinally to provide an annular area 66 about the periphery thereof respective to the cylindrical interior of the housing outlet. The annulus 66 directs the spiraling pocket of plastic towards the pipe wall.

Figure 10:
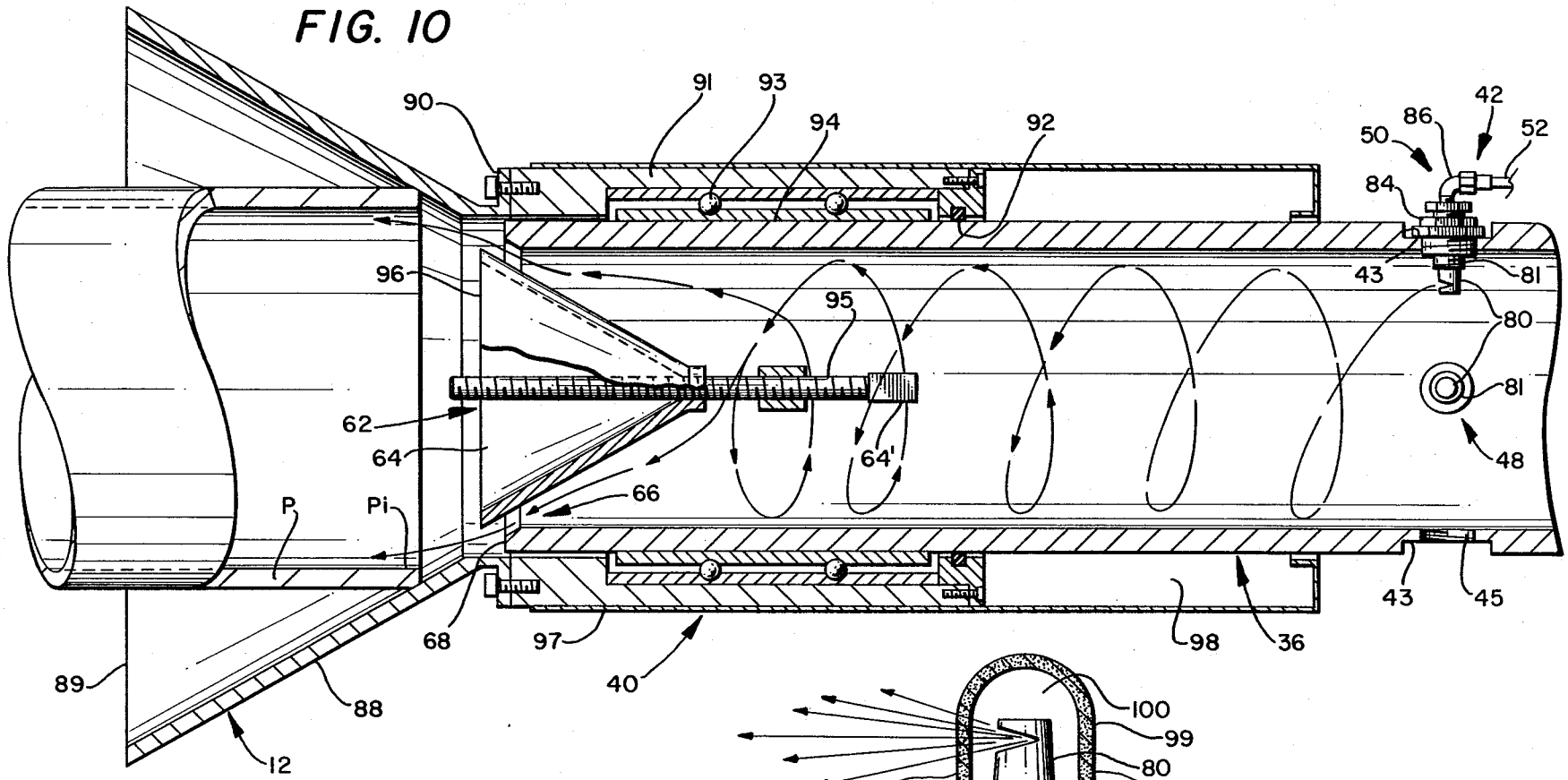
FIG. 10 is an enlarged, cross-sectional view of part of the apparatus disclosed in FIG. 2; and, FIG. 11 is an enlarged detailed view of part of the apparatus disclosed in the foregoing figures.

As seen in FIG. 10, numeral 68 indicates the terminal end of the housing 14. The pipe P has an inlet end PI which bears against the inner surface of the cone 12 and thereby provides the means by which pipe P can be removably attached to the outlet end of housing 14.

Figure 9:
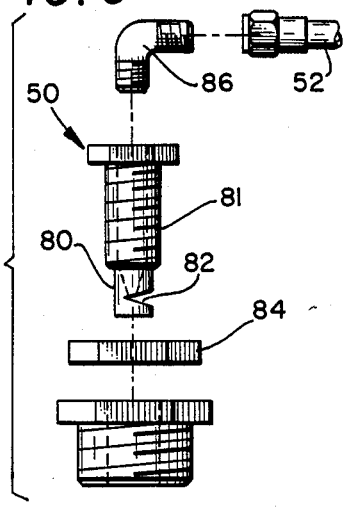
FIG. 9 is an enlarged, detailed view which discloses some details of part of the apparatus disclosed in FIG. 7.

As seen illustrated in FIGS. 2, 9, and 10, the tangential nozzel assembly 50 each comprise a removable nozzle 42 having an outlet 80 directed in a tangential direction. The nozzle 80 can take on several different forms.

As seen in FIG. 9, the nozzle assembly 50 includes a nozzle 80 Which is threaded at 81 and provided with outlet 82. Nut 84 enables the nozzle to be locked in direction so that once the optimum direction of flow from the nozzle has been tangentially arranged respective to the housing interior, the relative position of the nozzle can be locked into position.

Figure 11:
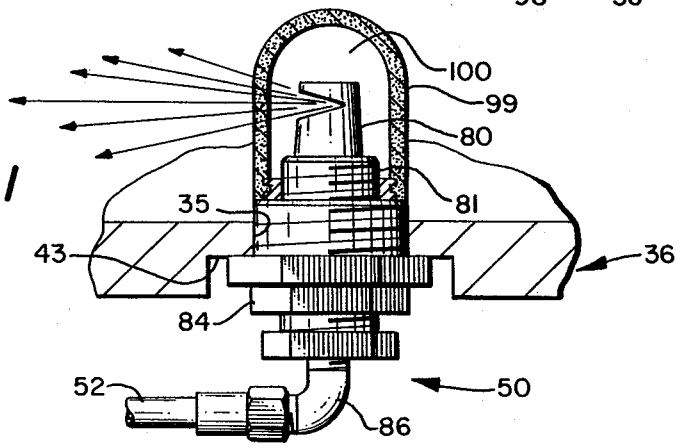

As seen in FIG. 11, it is sometime desirable to surround some of the lower nozzles with a pourous enclosure 99, as for example, pourous stone or stone like material such as associated with a grinding wheel. The enclosure 99 forms a chamber having an interior 100 so that air can flow through the enclosure 99 to thereby fluidize plastic powder that may be surrounding the enclosure 99.

Figure 3:
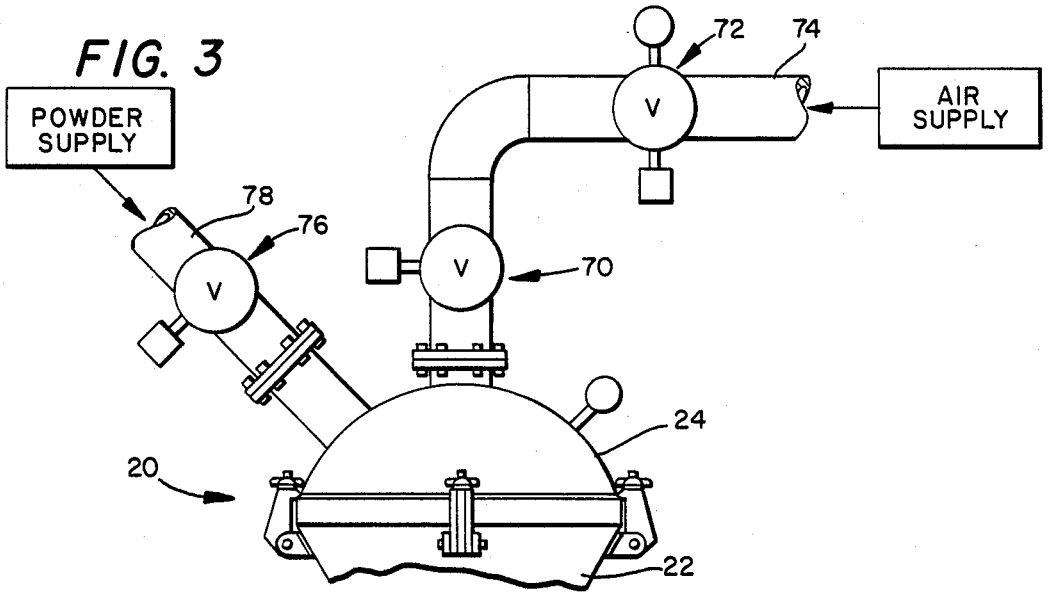
FIG. 3 sets forth an alternate embodiment of the apparatus disclosed in FIG. 2.
Figure 4:
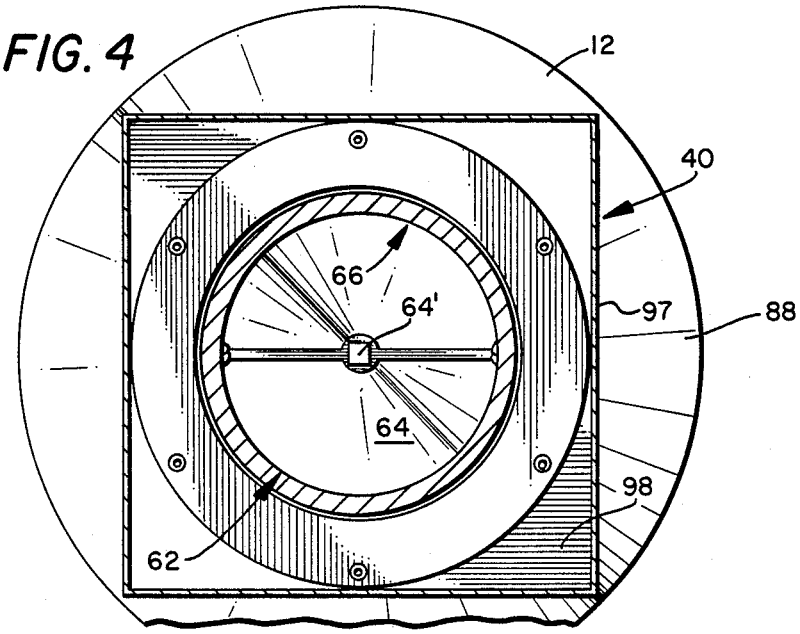
FIGS. 4, 5, 6, 7, and 8, respectively, are cross-sectional views taken along lines 4—4, 5—5, 6—6, 7—7 and 8—8, respectively, of FIG. 2.

In the alternate embodiment of that part of the apparataus set forth in FIG. 3, a valve 70 is connected downstream of pressure regulator 72, which in turn is connected to a suitable air supply by means of pipe 74. The valve 70 is adjusted to pressurize the container 20. The container 20 is connected to the inlet end of the housing 14 in the before described manner.

A valve 76 is connected to the interior of the container 20, and downstream of a source of powdered plastic. A specific weight of plastic in powder form flows from the indicated supply, through the pipe 78, valve 76, and into the container 20.

The powdered plastic material 34 used for coating pipe preferably is a synthetic resin, such as set forth in my copending patent application, of which this application is a Continuataion-in-Part. The temperature and rotational speed of the pipe can be adjusted to provide the most optimum value, or can be of the value set forth in my copending patent application.

In operation, the preheated pipe P is placed with the inlet end P1 in the illustrated position of FIG. 2 while the pipe is being rotated. The journal means 91, 92, 93 permit the cone 12 to rotate respective to the housing 12. The outlet end of the pipe can be connected to a separator means, as for example, a cyclone separator or a cloth filter known to those skilled in the art.

A suitable quantity of powdered plastic is charged through the closure means 24 and into the container 20. The container 20 is then pressurized to a pressure in excess of the pressure later to be effected within chamber 14. The tangential nozzles 42–48 have air flowing therethrough, while a source of air pressure is made available at air valve 58. Air valve 58 is closed. The powder valve 26 is opened so that the pressure within container 20 rapidly expells the powder therefrom and into a downstream location respective to the air inlet at 38. As soon as most of the powder has been translocated from container 20 into housing 14, the air valve is opened, thereby providing an axial air flow towards the end of the step of translocating the powder into the housing 14. During this time, tangential nozzles 42–48 have imparted a spiral or rotational flow into the air and powder mixture flowing from the housing and into the pipe P. The powder dumped through inlet port 32 from the container 20 therefore assumes the form of a pocket which flows through the housing and assumes a spiral flow path as the pocket is forced through the apparatus, through the pipe P, whereupon the individual particles of powder contained within the pocket are forced into contact with the heated sidewalls of the pipe, and fuse to the interior wall thereof. This action provides a uniform continuous coating of plastic on the pipe interior.

The following is a hypothetical example of coating a pipe using the present method and apparatus:

It is desired to uniformly coat the interior of a $2\frac{3}{8}$ inch diameter metal pipe with a 15 mil coating of plastic resin. A $5\frac{1}{4}$ pound charge of plastic is placed into container 20, allowing 10% loss at the pipe outlet.

The regulators 56 and 60 are set to provide the desired flow about 60% of which flows tangentially and 40% axially. The preheated pipe is at 375 Deg. F. and rotated at 135 RPM. After establishing the tangential air flow, powder valve 26 is opened and immediately thereafter, air valve 58 is opened. The time lapse between opening valves 26 and 58 is about $\frac{1}{2}$ second.

The air flow is continued for several seconds while rotation of the pipe is continued, in order to cool the fresh coating. The pipe is then removed and another preheated pipe placed in the illustrated position of FIGS. 1 and 2.

I claim:

1. Method of coating the interior of an elongated tubular member, such as oil field pipe, using a powdered synthetic resin which is fused into a continuous coating, comprising the steps of:

preheating the pipe to a temperature in excess of the fusion temperature of the powdered synthetic resin material;

rotating the preheated pipe about its longitudinal axis at a speed to cause any subsequently fused synthetic resin material to spread into a continuous film about the interior of the pipe;

providing an elongated cylindrical housing with an inlet end and an outlet end;

removably connecting one end of the preheated pipe to the outlet end of said elongated cylindrical housing;

flowing air tangentially into the elongated cylindrical housing at a location spaced from the inlet and outlet ends of said elongated cylindrical housing;

flowing air through an air valve means and axially into the inlet end of the elongated cylindrical housing;

storing a charge of powdered synthetic resin within a container separate from said cylindrical housing, and flowing the charge through a powder valve means and into the elongated cylindrical housing at a location downstream of the inlet end and upstream of the tangential air inlet; said charge contains an excess of powdered synthetic resin required to coat the interior of the pipe;

forming a pocket of powdered synthetic resin by sequentially operating the air valve means and the powder valve means respective to one another with said air valve means being opened immediately following expelling of the powered synthetic resin and thereby translocating the powdered charge by expelling a charge of powdered synthetic resin from the container into the elongated cylindrical housing, where the powdered synthetic resin admixes with the axial air flow and is forced downstream into the tangential air flow, whereupon the tangential air flow imparts a spiral flow into the pocket before the pocket enters the heated rotating pipe; said charge flows through the pipe as a spiraling pocket of powdered synthetic resin admixed with air; said pocket has a volume which is smaller than the volume of the pipe; said pocket flows only one time through the elongated cylindrical housing and into the pipe;

whereby, the preheated rotating pipe is internally coated with a continuous coating of the synthetic resin material.

2. The method of claim 1 wherein the step of flowing air axially into the inlet end of said cylindrical housing is carried out by communicating the inlet end of the housing with ambient while suction is applied to the outlet end of the pipe, whereupon, the suction, together with the tangential air flow, along with the flow from the container contribute to the formation of the pocket and provides a pressure differential which moves the pocket through the pipe.

3. The method of claim 1 and further including the step of elevating the internal pressure of the container to a value in excess of the pressure effected within the interior of the cylindrical housing so that a pressure differential across the charge rapidly translocates the charge from the container into the cylindrical housing within a time interval to cause said pocket to be formed, whereby the axial air moves the charge through the cylindrical housing and the tangential air subsequently rotates the mixture of air and powder charge contained therewithin so that the pocket is swirling before it reaches the inlet of the preheated pipe.

4. The method of claim 1 wherein said tangential air flow is achieved by arranging a plurality of nozzles circumferentially about the cylindrical housing, directing the outlet of the nozzles to produce a tangentially directed flow respective to the inside peripheral wall surface of the cylindrical housing.

5. Method of powder coating the interior of a joint of pipe with a powdered synthetic plastic resin material, comprising the steps of:

(1) preheating the pipe joint to be coated to a temperature in excess of the fusion temperature of the powdered plastic resin;

(2) rotating the preheated pipe joint about its longitudinal axis at a rotational velocity which causes any subsequently fused plastic resin material applied to the internal surface thereof to spread out into a uniform continuous film;

(3) removably connecting an inlet end of the rotating preheated pipe joint to an outlet end of a non-rotating cylindrical chamber, while the other end of the pipe joint is connected to a source of pressure which is less than the pressure contained within the cylindrical chamber; said cylindrical chamber having an inlet end spaced from said outlet end;

(4) isolating a charge of powdered plastic material within a container which is separate from the cylindrical chamber; said charge being in excess of the quantity of material required to coat the interior of the pipe joint;

(5) flowing air tangentially into a downstream marginal end of the cylindrical chamber by arranging at least one air nozzle to produce an air flow which moves tangentially respective to the interior of the chamber;

(6) flowing air through an air valve means and axially into the inlet end of the chamber;

(7) transferring the charge of plastic powder from said container, through a powder valve means, and into the chamber by sequentially operating the air valve means respective to the powder valve means within a time interval that results in the entire charge assuming the form of a fluidized pocket of plastic resin material which has a length less than the length of the joint of pipe;

(8) transferring said charge into said chamber at a location upstream of said nozzle and downstream of the axial air inlet end;

(9) whereby; said pocket assumes a spiral flow pattern as the pocket flows through the outlet end of the chamber and through the pipe, and the plastic material contained within the pocket contacts and fuses to the interior wall of the pipe to form a continuous coating.

6. The method of claim 5 wherein there are a plurality of nozzles arranged circumferentially about the chamber, said nozzles having an outlet arranged tangentially respective to the inside peripheral wall surface of the cylindrical chamber.

7. The method of claim 5 wherein the internal pressure of the powder container is elevated to a value in excess of the pressure effected on the interior of the chamber so that a pressure differential across said powder charge translocates the charge from the container into the chamber where the axial air flow augments movement of the charge through the chamber as the tangential air flow rotates the mixture of air and powdered plastic material contained within the pocket.

8. The method of claim 7 wherein there are a plurality of nozzles arranged circumferentially about the chamber, said nozzles having an outlet arranged tangentially respective to the inside peripheral wall surface of the cylindrical chamber.

9. Method of applying a coating of plastic resin on the interior of a joint of pipe by using a powdered plastic resin material, comprising the steps of:

(1) selecting a plastic resin material in particulate form which is capable of being fused to the interior wall surface of the joint of pipe;

(2) preheating the joint of pipe to a temperature in excess of the fusion temperature of the plastic resin material;

(3) rotating the preheated joint of pipe about its longitudinal axis at a speed which enables any subsequently fused plastic resin material to spread onto the interior wall surface of the joint of pipe as a continuous film;

(4) providing an elongated cylindrical housing with an inlet and an outlet, isolating a charge of the plastic resin material of step (1) within a container; said charge being in excess of the amount of plastic resin material required to uniformly coat the interior wall surface of the joint of pipe;

(5) flowing air through an air valve means, into said housing inlet, and axially respective to the interior of said housing; flowing air through a nozzle arranged tangentially respective to the axial air flow at a location downstream of the housing inlet and upstream of the housing outlet;

(6) communicating one end of the rotating, preheated, joint of pipe with the outlet of the housing while connecting the other end of the joint of pipe to a source of reduced pressure respective to the interior of the cylindrical housing;

(7) using a powder valve means to connect said container to said cylindrical housing so that said charge can be rapidly transferred from the container into the cylindrical housing at a location upstream of said tangential air flow from said nozzle;

(8) forming the charge of plastic resin material into a pocket comprising a mixture of air and plastic resin material by sequentially opening the air valve means and powder valve means and forcing the entire isolated charge of step (4) to flow from said container into the interior of the housing at a rate of flow which results in a pocket volume which is less than the volume of the joint of pipe, whereupon the pocket enters the pipe as it spirals about the longitudinal axis of the joint of pipe and plastic resin particles contact and fuse to the interior sidewall of the joint of pipe to provide the aforesaid coating of plastic resin.

10. The method of claim 9 and further including the steps of elevating the internal pressure of the powder container to a value in excess of the pressure effected on the interior of the chamber whereby a pressure differential is effected across said powder charge and thereby translocates the charge from the container into the chamber where the axial air flow augments movement of the charge through the chamber as the tangential air flow rotates the mixture of air and powdered plastic material contained within the pocket.

11. The method of claim 9 wherein step (5) is carried out by arranging a plurality of nozzles circumferentially about the chamber, with said nozzles having an outlet arranged tangentially respective to the inside peripheral wall surface of the cylindrical chamber.

12. Apparatus for powder coating the entire inside surface of an oil field pipe joint with a heat fusible powdered plastic resin, comprising:

preheating means for heating the pipe joint to a temperature about the melting temperature of the powdered plastic resin; means for rotating the pipe joint about its longitudinal axis;

means forming an elongated housing having an inlet spaced from an outlet, means forming a powder containing container separate from said housing, means by which said housing outlet can be removably flow connected to the inlet end of the rotating pipe to be coated;

powder valve means including a powder inlet connecting the container interior to the interior of said housing at a location downstream of said inlet; air valve means connected to provide said container and said housing inlet with a source of compressed air;

means by which a charge of powdered plastic resin can be placed within said container; said charge being of sufficient quantity to coat the inside of the pipe joint;

air nozzle means supported by said housing and directed tangentially respective to the housing interior for producing a spiral flow of air within the marginal outlet end of the housing and through the pipe joint; said nozzle means are arranged about the circumference of the housing and have an outlet oriented to flow in a circumferential direction respective to the housing interior, said nozzle means being located downstream of the powder inlet and said powder inlet being located downstream of said housing inlet;

whereby, when said air valve means and said powder valve means are moved to the open position, the charge of plastic resin is changed into a fluidized pocket of plastic particles which flow in a spiral through the pipe joint as the particles of plastic deposit and fuse to the interior wall of the pipe joint.

13. The apparatus of claim 12 wherein means are provided by which said nozzles can be oriented between a tangential direction and a downstream direction; and, said container includes means by which the pressure thereof can be elevated above the maximum pressure of the housing, so that the chrage contained therewithin is instantaneously translocated into the housing.

* * * * *